United States Patent [19]

Nakajima

[11] Patent Number: 4,837,045

[45] Date of Patent: Jun. 6, 1989

[54] COATING METHOD

[75] Inventor: Kenji Nakajima, Kanagawa, Japan

[73] Assignee: Fuji Photo Film Co., Ltd., Kanagawa, Japan

[21] Appl. No.: 66,272

[22] Filed: Jun. 25, 1987

[30] Foreign Application Priority Data

Jun. 25, 1986 [JP] Japan ..... 61-148399

[51] Int. Cl.[4] ..... B05D 1/04

[52] U.S. Cl. ..... 427/13; 427/131; 427/208.8; 427/294; 427/407.1

[58] Field of Search ..... 427/13, 407.1, 294, 427/131, 208.8

[56] References Cited

U.S. PATENT DOCUMENTS 3,220,843 11/1965 Lovick et al. ..... 96/84
3,462,286 8/1969 De Geest et al. ..... 427/13
3,531,322 9/1970 Kefalas et al. ..... 117/236
4,457,256 7/1984 Kisler .

OTHER PUBLICATIONS

W. D. E. Thomas et al., "Solution/Air Interfaces", Journal of Colloid & Interface Science, vol. 50, No. 3, Mar. 1975.

Research Disclosure 24,934 of Jan. 1985.

*Primary Examiner*—Bernard Pianalto

*Attorney, Agent, or Firm*—Sughrue, Mion, Zinn, Macpeak & Seas

[57] ABSTRACT

A coating method in which the web is first undercoated with a gelatin layer containing a surface active agent. There the web is advanced over a drum held at a high DC potential and a coating composition is extruded on the gelatin layer.

5 Claims, 1 Drawing Sheet

COATING METHOD

BACKGROUND OF THE INVENTION

This invention relates in general to the art of coating and in particular to an improved method for carrying out a process of coating in which one or more layers of coating composition are applied to the surface of an object by advancing the object through a coating zone in which a flow of coating composition is applied thereto, for example, a process of bead coating or a process of curtain coating. More specifically, this invention relates to an improved coating method in the manufacturing of a photographic film, photographic printing paper, a magnetic recording tape, an adhesive tape, pressure-sensitive recording paper, an offset printing plate material or the like.

A method of applying an electrostatic field to act has been disclosed along with a conventional method of coating to a continuously moving web by applying the electrostatic field to act on the web. For example, there has been a device disclosed in the Japanese Patent No. 27423/71 in which a backup roller is kept at a high potential to generate an electrostatic field between a coating hopper and the backup roller to exercise a method of applying the electrostatic field to act between the coating hopper and the backup roller or between the coating hopper and a web. A device for subjecting a web to a corona discharge treatment to cause an electrostatic field to act between a coating hopper and the web was disclosed in the published Japanese Patent Application (OPI) No. 167750/82 (the term "OPI" as used herein means an "unexamined published application").

Such a method of applying an electrostatic field to act produces an effect which prevents an air film often made on a rapidly moved web in coating to the web from hindering the liquid from wetting the web. However, there has not been a patent application in which the quality and structure of the surface of a web are descibed with regard to a method of coating to the web by applying an electrostatic field to act thereto.

In order to increase the speed of coating of a liquid to a web without increasing the load of drying the coated layers, it is necessary to increase the concentration of a solute in the coated layer, for example, the concentration of gelatin which is often used as the protective binder of a photographic photosensitive material. However, there is a problem that if the web is provided with an undercoating layer of gelatin to augment the adhesive power between the web and the coated layer, the speed of coating the web can hardly be increased by a method in which an electrostatic field is caused to act to the web to coat the liquid thereto.

SUMMARY OF THE INVENTION

Accordingly, it is an object of the present invention to provide a method in which the speed of coating to a web is increased without increasing the load of drying of the coated layers.

In the method, an electrostatic field is applied to act on a continuously moving web having an undercoating layer of gelatin, to thus coat the web. The method is characterized in that a surface active agent is previously added to the undercoating layer of gelatin.

DETAILED DESCRIPTION OF THE PREFERRED EMBODIMENTS

Figure 1:
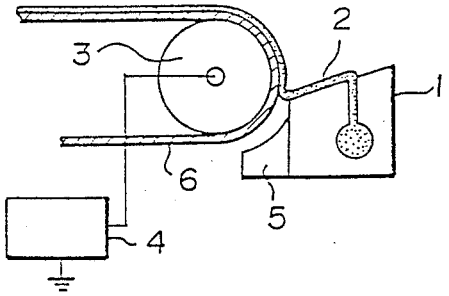
FIG. 1 shows a side view indicating the concept of a coating method which is an embodiment of the present invention.

According to the present invention, as shown in FIG. 1, a web 6 having an undercoating layer of gelatin to which a surface active agent is previously added is wound on a backup roller 3 so that the web is continuously advanced. When a liquid 2 flowing out of a coating hopper 1 is applied to the web 6 on the side of the undercoating, a pressure reduction chhamber 5 performs application stabilization based on pressure reduction and a high DC voltage source 4 performs coating stabilization based on the action of the electrostatic field. Since the web 6 is provided with the undercoating layer of gelatin to which the surface active agent is previously added, the degree of affinity between the web 6 and the coated layer is enhanced to promote the stabilization based on the action of the electrostatic field. This makes it possible to increase the speed of the coating.

The hydrophobic group of the surface active agent is a straight-chain alkyl group or an alkyl group having a side chain or a hydrocarbonaceous functional group having a benzene ring or the like, but the hydrophobic group is not confined to them. The hydrophilic group of the surface active agent is an anionic function group of sodium carboxylate, sodium sulfonate or the like, a cationic or ampholytic functional group of an ammonium salt, a sulfonium salt or the like, or a nonionic functional group of polyethylene oxide or the like, but the hydrophilic group is not limited thereto.

It is preferable that the quantity of the surface active agent per unit area of the web is $1\times10^{-3}$ mol/m$^2$ to $1\times10^{-6}$ mol/m$^2$.

The web is paper, a plastic film, a resin-coated paper, synthetic paper or the like. The plastic film is made of a polyolefin such as polyethylene and polypropylene, a vinyl polymer such as polyvinyl acetate, polyvinyl chloride and polystyrene, a polyamide such as 6,6-nylon and 6-nylon, a polyester such as polyethylene terephthalate and polyethylene-2,6-naphthalate, polycarbonate, a cellulose acetate such as cellulose triacetate and cellulose diacetate, or the like. The resin for the resin-coated paper is a polyolefin such as polyethylene but is not confined thereto.

The composition of the liquid varies according to the use thereof. For example, the liquid may be used to form a photosensitive emulsion layer, undercoating layer, protective layer, back layer or the like of a photographic photosensitive material, a magnetic layer, undercoating layer, lubricant layer, protective layer, back layer or the like of a magnetic recording medium, an adhesive layer, a coloring layer, an anti-rusting layer or the like. The coating composition contains a water-soluble binder or an organic binder.

The coating method is a slide coating method, a roller bead coating method, a spray coating method, an extrusive coating method, a curtain coating method or the like.

A coating method, which is an embodiment of the present invention, is hereafter described in detail with regard to an actual use.

A coating composition for photographic purposes was prepared by adding 1.5 g/l of sodium dodecylbenzenesulfonate as a surface active agent and a red dye to an aqueous solution of alkali-treated gelatin (whose weight concentration was 10%). The liquid was caused to flow out of a coating hopper so that the quantity of the coating composition per unit area of a web was 40 $ml/m^2$.

The web was a polyethylene terephthalate film and had a thickness of 100 μm. To the web was undercoated a layer of alkali-treated gelatin to which sodium dodecylbenzenesulfonate was added as a surface active agent. The undercoated layer of alkali-treated gelatin had a thickness of 0.3 μm. The quantity of the sodium dodecylbenzenesulfonate per unit area of the web was $2.0\times10^{-5}$ $mol/m^2$.

For comparisoN, three undercoated layers were provided on polyethylene terephthalate films as webs: (1) an undercoating layer of only alkali-treated gelatin; (2) an undercoating layer of alkali-treated gelatin to which a polyoxyethylene alcohol ether having ten ethylene oxide groups was added; and (3) an undercoated layer of alkali-treated gelatin to which a potassium carbonate salt relating to carbon fluoride was added. Each of the films had a thickness of 100 μm. Each of the undercoated layers had a thickness of 0.3 μm. The quantity of each of the added substances per unit area of the web was $2.0\times10^{-5}$ $mol/m^2$, which was the same as the sodium dodecylbenzenesulfonate.

A high DC voltage of 1,000 V was impressed on the backup roller 3.

The pressure of a pressure reduction chamber 5 was set to be 30 mm $H_2O$ lower than the atmospheric pressure.

The device shown in FIG. 1 was used to coat to each of the webs under the above-described conditions. The application speed at which a phenomenon that an air film accompanying the moving web hinders the liquid from wetting the web took place was measured with regard to each of the undercoating layers. The results of the measurements are shown in Table 1.

As shown in Table 1, it was proven that the coating speed with the action of an electrostatic field thereto could be much increased by adding the hydrocarbonaceous surface active agent to the undercoating layer of gelatin on the web in accordance with the present invention.

The present invention is not confined to the above-described embodiment but may be embodied in other various ways without departing from the spirit or character of the invention. For instance, an electric field may be applied to the web by corona discharge.

What is claimed is:

1. A coating method, comprising the steps of:

undercoating a web with a layer of gelatin containing a surface active agent;

continuously advancing said web;

coating a material to said layer of gelatin undercoated on said web; and applying an electrostatic field on said moving web during said coating step.

2. A coating method as recited in claim 1, wherein applying step impresses a DC voltage on a roller used in advancing said web and facing a point of coating.

3. A coating method as recited in claim 2, wherein said surface active agent includes sodium dodecylbenzene sulfonate.

4. A coating method as recited in claim 1, wherein said web is undercoated with said layer of gelatin containing said surface active agent in an amount of $1\times10^{-3}$ to $1\times10^{-6}$ $mol/m^2$.

5. A coating method as recited in claim 1, wherein said coating a material to said layer of gelatin undercoated on said web occurs in a pressure reduction chamber, wherein the pressure at the lower side of thee coating bead is less than that of the upper side thereof, as a result of which a difference in pressure the coating bead is urged in the direction opposite to a running direction of the support, said difference in pressure being sufficient to prevent forming of an air film on said support during coating.

* * * * *

TABLE 1

| Voltage impressed on application roller | Additive to undercoating layer of gelatin on web | | | |
|---|---|---|---|---|
| | None | Sodium dodecylbenzene-sulfonate | Polyoxyethylene alcohol ether | Potassium carbonate salt relating to carbon fluoride |
| 0 V | 130 m/min. | 117 m/min. | 128 m/min. | 95 m/min. |
| 1,000 V | 135 m/min. | 350 m/min. | 245 m/min. | 96 m/min. |